United States Patent [19]

Beretta

[11] 4,359,834

[45] Nov. 23, 1982

[54] MULTIPOSITIONED TWO-LEGGED SUPPORT FOR PORTABLE AUTOMATIC WEAPONS

[75] Inventor: Pier C. Beretta, Gardone V. T., Italy

[73] Assignee: Fabbrica D'Armi P. Beretta S.p.A., Italy

[21] Appl. No.: 230,436

[22] Filed: Feb. 2, 1981

[30] Foreign Application Priority Data

Mar. 7, 1980 [IT] Italy ..... 5128 A/80

[51] Int. Cl.[3] ..... F41C 29/00

[52] U.S. Cl. ..... 42/94

[58] Field of Search ..... 42/94; 89/37 B, 37 BA, 89/40 E; 248/168, 434, 435

[56] References Cited

U.S. PATENT DOCUMENTS 4,288,939 9/1981 Beretta ..... 42/94

*Primary Examiner*—Stephen C. Bentley

*Attorney, Agent, or Firm*—McGlew and Tuttle

[57] ABSTRACT

A support weapon is provided having two feet that are independent of each other and which are comprised of foldable rods that are capable of angular displacement and which are also capable of being set up and secured in various angular positions so as to vary at will, the height of the support. Furthermore the foldable rods are foldable on themselves and also rotatable and movable in a parallel fashion to the sides of the frame of the weapon.

1 Claim, 10 Drawing Figures

MULTIPOSITIONED TWO-LEGGED SUPPORT FOR PORTABLE AUTOMATIC WEAPONS

FIELD OF THE INVENTION

The present invention is generally related to a support for portable automatic weapons to be rested on the ground, the automatic weapon being, for example, machine pistols and light machine guns. More particularly the invention relates to a two-legged, multipositioned support for portable automatic weapons which is foldable in a direction towards the sides of the frame of the weapon.

BACKGROUND OF THE INVENTION

Devices for supporting portable automatic weapons on the ground during their use are already known. For example, a type of support is known which has two legs divergent from each other and telescopically extendable, which, however, are not suitable for a simple and easy positioning or set up. This is so, because, by varying the length of the divergent feet of the telescopically adjustable support, the amplitude of the supporting base for the weapon is also varied and this does not permit, especially when the length of the telescopically extendable feet is reduced, a resting base that always insures a sufficiently satisfactory support of the weapon due to the restriction of the supporting base.

Furthermore, the two telescopic feet, although they are adjustable in length, one independently of the other for resting on uneven terrain, do not permit the stability of the weapon to be effectively maintained on terrains which are particularly inclined, and cannot be supported on the ground by means of stabilizers such as sandbags and the like, because they do not offer any portion thereof on which such means are capable of resting.

BRIEF DESCRIPTION OF THE INVENTION

Contrary to the above deficiencies, it is within the scope of the present invention to provide a support having the above-mentioned function which support has two feet that are independent of each other and are comprised of foldable rods which are capable of angular displacement and which are also capable of being set up and secured in various angular positions so as to vary, at will, the height of the support. Furthermore the rods are foldable on themselves and also rotatable and movable in a parallel fashion to the sides of the frame of the weapon.

It is another object of the present invention to provide a two footed support with means for automatically stopping development thereof so as to prevent any uncontrolled opening of the foldable rods which form the feet of the support, when these have been rotated in position to approach the frame of the weapon.

BRIEF DESCRIPTION OF THE DRAWINGS

These and other objects and advantages of the present invention will become apparent from the following description of the embodiments thereof taken in connection with the accompanying drawings which are strictly illustrative and not limitative to the invention, in which.

DETAILED DESCRIPTION OF THE INVENTION

Figures 2, 3:
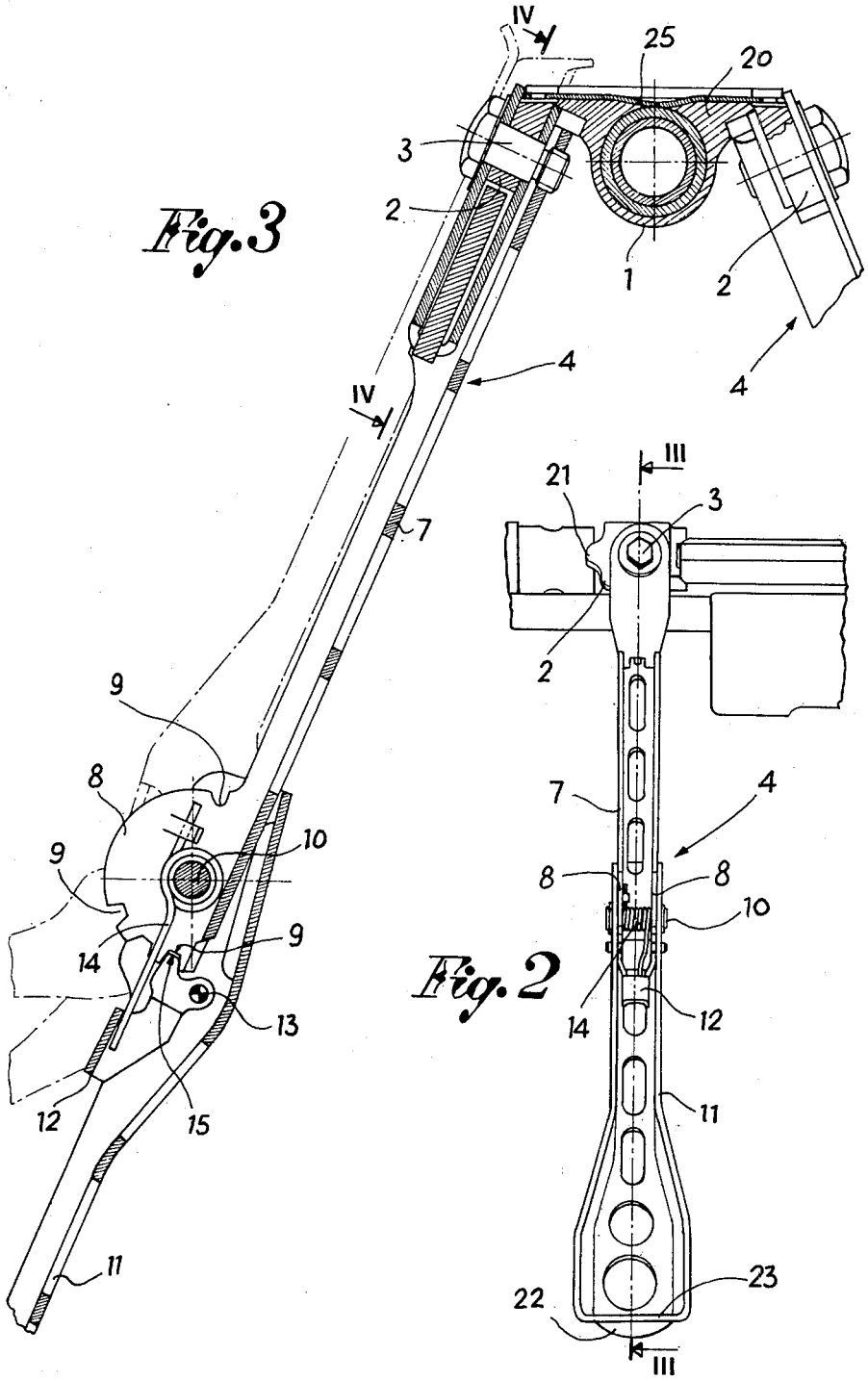
FIG. 2 is a side elevational view, on an enlarged scale, of one foot of the support in a condition corresponding to that of FIG. 1.
FIG. 3 is a longitudinal sectional view taken along lines III—III of FIG. 2.
Figure 4:
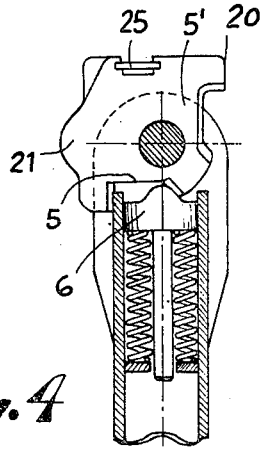
FIG. 4 is a fragmentary sectional view taken along the lines IV—IV of FIG. 3.

The support of the present invention comprises a sleeve 1 which is integral with a pair of laterally extending, oppositely directed arms 20 on the opposed extremities of which there are provided, one on each side, two wings 2 which face downwardly and which are divergent from each other as shown in FIG. 3. To each wing 2 there is pivotably attached, by means of a fastener 3, a foldable rod 4 which may be rotated from a perpendicular position to a parallel position with respect to the axis of the sleeve 1 and vice versa. These two extreme positions are defined by shoulders 5, 5' on each wing 2 which shoulders form an arresting means or stops. The arresting means are spring loaded such as for example by a latch 6 mounted on each rod as represented for example in FIG. 4 of the accompanying drawings.

Figure 7:
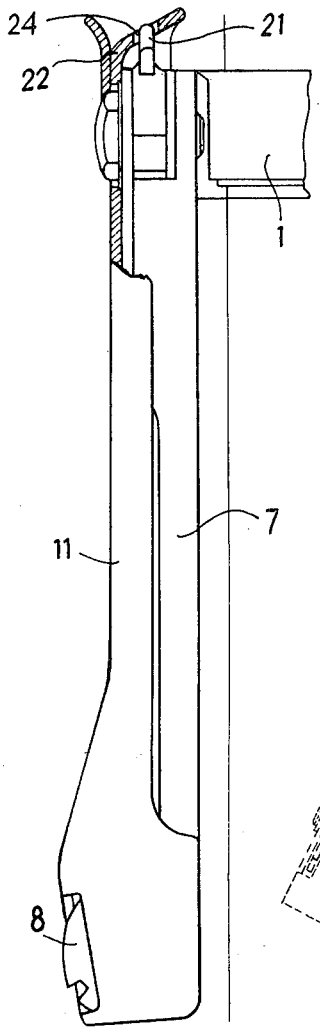
FIG. 7 is a fragmentary view, partially in section, taken along lines VII—VII of FIG. 6.
Figure 6:
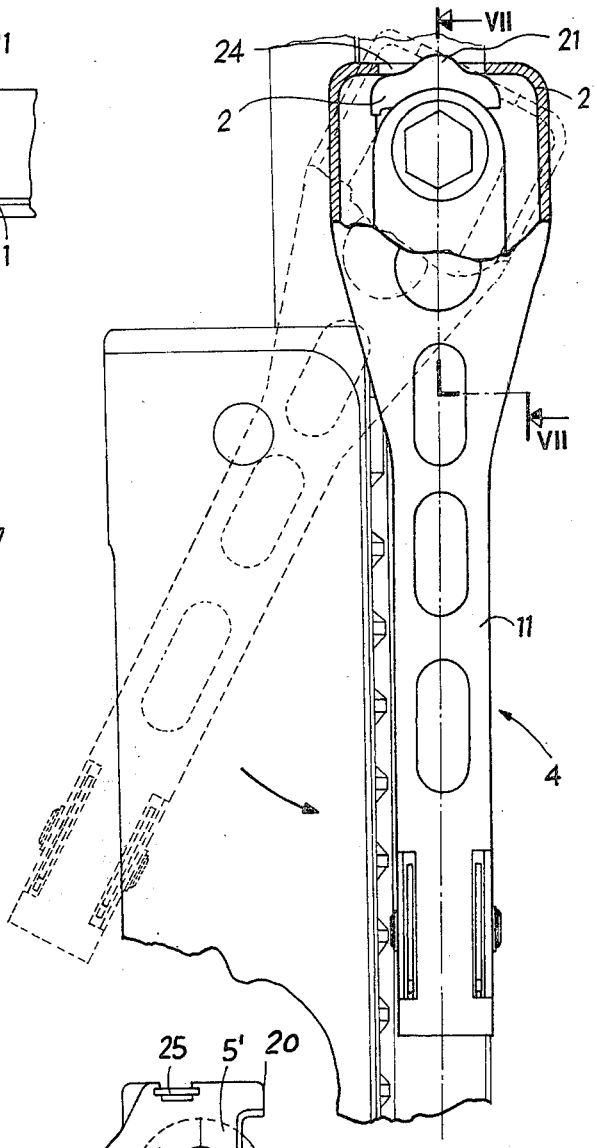
FIG. 6 is an enlarged elevational view, partially in section, of one foot of the support comprising this invention in a position corresponding to FIG. 5.

On one side of each wing 2, and more precisely on the side which is opposite to that toward which the foldable rod 4 is rotated in order to approach the frame of the weapon, there is provided (FIGS. 6 and 7) an arresting tooth 21, the function of which will be described in greater detail hereinafter.

Each foldable rod 4 of the support comprises a first section 7 with one extremity that is pivotably attached by the fastener 3 to the relative wing 2 of the arms 20 and with the opposite extremity provided with a pair of arcuate or semi-circular portions 8, and a second section 11 that is pivotably attached by means of a transverse pivot pin 10 to the semi-circular portions 8. The second section 11 serves the purpose of forming the foot which rests on the ground.

On the periphery of the semi-circular portions 8 there are provided a plurality of notches 9 which may be radial and which are spaced angularly from one another. To the second section 11, which serves as a foot, there is instead pivotably attached at 13 an arresting lever 12 which is urged by a torsion spring 14 and has at least one projection 15 facing toward and engaging one or the other of the radial notches 9 of the semi-circular portions 8 of the first section 7 of the foldable rod 4.

The free extremity of each of the second sections 11 opposite the pin 10, constituting the feet that are adapted to rest on the ground, has a cap shaped portion 22 with a rim or border 23 in which there is provided a cut 24. The cap portion 22 serves the purpose of covering and enclosing the wing 2 and the terminal of the first section 7 that is pivotably attached thereto, when said section 11, which serves as a foot is folded and approaches the first section 7. In turn, the cut 24 of the rim 23 of the cap portion 22 serves to receive and be coupled to the arresting tooth 21 of the relative wing 2 when, after the second section 11 is moved toward the first section 7, the folded rod 4 is rotated to the side of the frame of the weapon in an inactive position.

Figure 1:
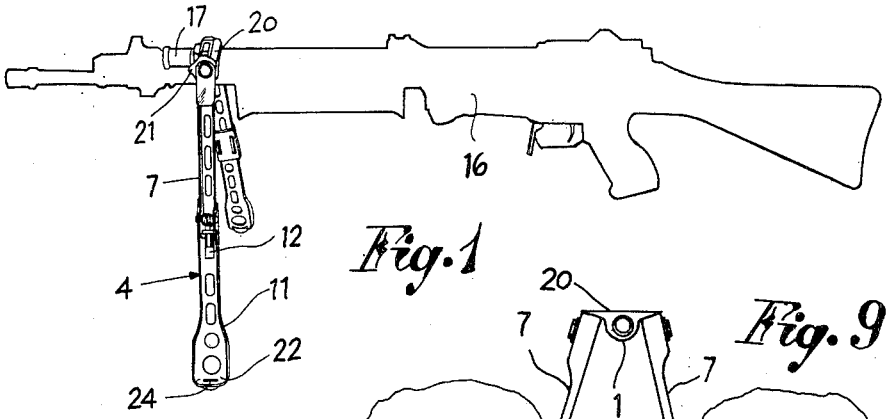
FIG. 1 is a perspective view of a machine pistol complete with a two footed support comprising the present invention in position of use.
Figure 9:
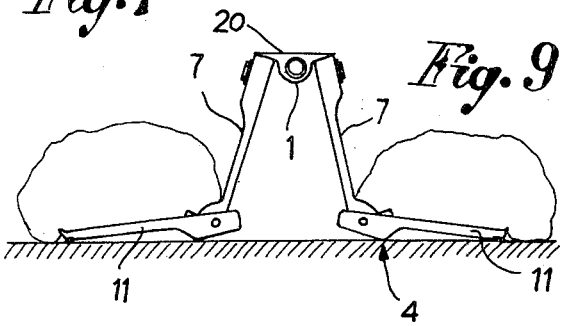
FIGS. 8, 9 and 10 are three schematic representations of other, different positions of use of the support.
Figure 8:
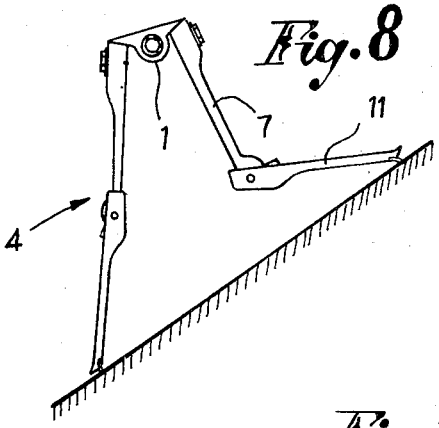
Figure 10:
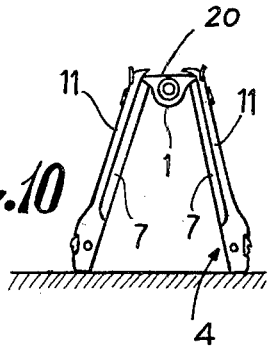
Figure 5:
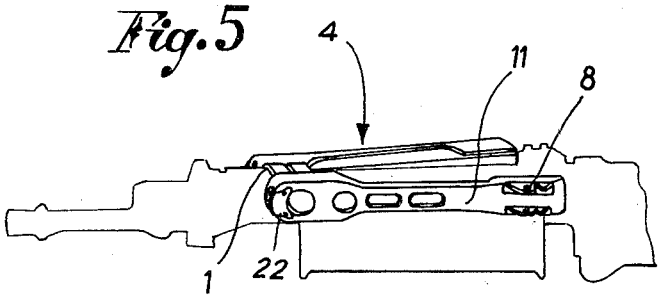
FIG. 5 is a fragmentary perspective view, similar to FIG. 1, of a machine pistol with a support displaced in an inactive position.

The application of the support hereinabove described to the weapon itself, such as the machine pistol 16 of the type shown in the drawing, is achieved by coupling the sleeve 1 with the tube 17 of which the weapon itself is provided as shown in FIG. 1. Such a coupling is obtained, for example, by means of a bayonet-type connection with an annular development constituted by a semicircular rim provided on one extremity of the sleeve 1 and engaging a rotationally corresponding seat or semicircular throat provided for that purpose on the tube 17. Such coupling prevents any axial displacement of the support on the weapon while favoring a certain degree of orientation of the entire support about the tube 17 within the room allowed by the resting of the support itself against the barrel which protrudes parallel to the tube.

The rod-like sections 11 which comprise the feet which rest on the ground, are displaceable angularly about their respective pivots 10 from a position of alignment with the first sections 7 pivotably attached to the wings 2 to a position of folding and approaching the sections 7. This occurs by passing through a series of positions that are obtained by engaging, one after the other, the arresting layer 12 with one or the other of the radial notches 9 of the semi-circular portions 8. To the extreme positions and intermediate positions of the sections 11 which serve as the feet, correspond an equal number of possibilities of utilization of the support, some of which are represented in FIGS. 1, 5, 8 and 9 of the accompanying drawings. It is thus possible also to have an easy and comfortable adaptation of the support to whatever characteristic or regularity or inclination of the resting plane, which adaptability is also guaranteed by the possibility of regulating in an adequate manner the position of each rod 4 independently of the other rod 4.

An advantage is also derived by being able to always maintain the baricenter of the barrel of the weapon within the center line of the arresting plane so as to insure the stability of the support of the weapon under any condition of utilization and under any condition of terrain. On the other hand, the construction of this invention permits the enlargement and widening of the resting base as the effective height of the support is, little by little reduced, contrary to what occurs in the heretofore known prior art constructions with telescopically extending feet. The device of the present invention also has the advantage of maintaining the stability of the support. When the foot or feet 11 are horizontally oriented it is possible to mount other securing means thereon, as for example sandbags, in order to stabilize the position of the support and therefor of the weapon.

When the sections 11 which serve as feet are moved towards the sections 7, the rods 4 of the support may be rotated into an inactive or inoperative position by angular displacement about the relative pivoting points defined by the fasteners 3 in the wings 2. With such a displacement (See FIG. 6 in particular) the arresting tooth 21 of each wing is inserted spontaneously or automatically in the cut 24 of the cap portion 22 thus blocking the section 11 to the section 7. In this way the possibility is eliminated of having an uncontrolled opening of the support due to vibrations or to erroneous maneuvers and also the possibility is prevented of ruining or notching the breach of the weapon by means of or through the terminals of the opening sections 11 and also of ruining the arresting notches of the support due to erroneous operation of the same.

It is understood that without departing from the scope of the present invention, the support hereinabove described may be modified in certain details, without changing nevertheless the main advantages and purposes hereinabove described. Thus, for example, to the arms 20 that are integral with the sleeve 1 there may be associated an elastic element 25 which serves to develope friction on the tube 17 to which the sleeve 1 is coupled in order to obtain some sort of frictional displacement of the support of the tube 17.

What is claimed is:

1. A multiposition, two-footed support for portable automatic weapons, said support comprising a sleeve, a pair of laterally extending oppositely directed arms integral with said sleeve, two wings provided at the extremities of said arms each said wing having a lateral arresting tooth and two foldable rods pivotably coupled to said two wings and angularly displaceable from a parallel position to a perpendicular position with respect to the frame of the weapon, said two foldable rods each comprising a first and a second section pivotably connected to their contiguous extremities so as to pass from a position of alignment to a position adjacent the weapon through an angular displacement including a plurality of intermediate positions defined by an arresting lever on one of said sections cooperating with arresting notches provided on the other said section, said second section comprising a resting foot and having a cap shaped terminal with a rim having a cut which serves to receive and couple said lateral arresting tooth of said respective wing when said second section approaches said first element and both sections are rotated so as to position themselves parallel to the side of the frame of the weapon.

* * * * *